US008974317B1

(12) United States Patent
Griffin et al.

(10) Patent No.: US 8,974,317 B1
(45) **Date of Patent: *Mar. 10, 2015**

(54) MULTIPLE-MATERIAL IRON

(71) Applicant: Callaway Golf Company, Carlsbad, CA (US)

(72) Inventors: Sean Griffin, Carlsbad, CA (US); Steven M. Ehlers, Poway, CA (US)

(73) Assignee: Callaway Golf Company, Carlsbad, CA (US)

( * ) Notice: Subject to any disclaimer, the term of this patent is extended or adjusted under 35 U.S.C. 154(b) by 207 days.

This patent is subject to a terminal disclaimer.

(21) Appl. No.: 13/767,751

(22) Filed: Feb. 14, 2013

Related U.S. Application Data

(63) Continuation-in-part of application No. 13/761,863, filed on Feb. 7, 2013, now Pat. No. 8,821,313.

(60) Provisional application No. 61/701,533, filed on Sep. 14, 2012.

(51) Int. Cl.
*A63B 53/04* (2006.01)

(52) U.S. Cl.
CPC ..... *A63B 53/0475* (2013.01)
USPC ..... 473/290; 473/291; 473/342; 473/347; 473/349; 473/350

(58) Field of Classification Search
CPC ..... A63B 53/0475; A63B 2053/0491; A63B 2059/0003
USPC ..... 473/324–350, 287–292
See application file for complete search history.

(56) References Cited

U.S. PATENT DOCUMENTS

| | | | | | |
|---|---|---|---|---|---|
| 2,846,228 | A * | 8/1958 | Reach | 473/332 |
| 4,667,963 | A * | 5/1987 | Yoneyama | 473/348 |
| 4,793,616 | A * | 12/1988 | Fernandez | 473/347 |
| 4,824,110 | A * | 4/1989 | Kobayashi | 473/332 |
| 4,964,640 | A * | 10/1990 | Nakanishi et al. | 473/335 |
| 5,290,036 | A * | 3/1994 | Fenton et al. | 473/332 |
| 5,348,302 | A * | 9/1994 | Sasamoto et al. | 473/346 |
| 6,030,295 | A * | 2/2000 | Takeda | 473/345 |
| 6,918,840 | B2 * | 7/2005 | Stites et al. | 473/291 |
| 6,942,580 | B2 * | 9/2005 | Hou et al. | 473/332 |
| 7,137,903 | B2 * | 11/2006 | Best et al. | 473/290 |
| 7,207,899 | B2 * | 4/2007 | Imamoto | 473/332 |
| 7,303,489 | B2 * | 12/2007 | Gilbert et al. | 473/350 |
| 7,410,427 | B2 * | 8/2008 | Imamoto et al. | 473/345 |
| 8,079,919 | B2 * | 12/2011 | Roach et al. | 473/350 |
| 8,475,293 | B2 * | 7/2013 | Morin et al. | 473/329 |
| 8,647,218 | B2 * | 2/2014 | Gilbert et al. | 473/346 |
| 2001/0055996 | A1 * | 12/2001 | Iwata et al. | 473/350 |
| 2004/0266550 | A1 * | 12/2004 | Gilbert et al. | 473/345 |

(Continued)

*Primary Examiner* — Sebastiano Passaniti
(74) *Attorney, Agent, or Firm* — Rebecca Hanovice; Michael A. Catania; Sonia Lari

(57) ABSTRACT

The present invention discloses an iron-type golf club head formed from multiple materials that increase torsional stiffness of the club and aid in sound performance. In particular, the iron-type golf club head includes a rear flange and a composite component bonded to an external surface of the rear flange. The composite component may cover an entire surface of the rear flange, and may also extend upwards to make contact with a top portion of the club head and thus close off a rear cavity of the club head. The iron-type golf club head may further comprise a face support structure extending from the rear flange, to which the face plate may be affixed via welding or brazing.

4 Claims, 3 Drawing Sheets

(56) References Cited

U.S. PATENT DOCUMENTS

2007/0123366 A1* 5/2007 Solari ..... 473/349
2009/0069116 A1* 3/2009 Chen ..... 473/350
2009/0082133 A1* 3/2009 Tseng ..... 473/349

* cited by examiner

MULTIPLE-MATERIAL IRON

CROSS REFERENCES TO RELATED APPLICATIONS

The present application is a continuation-in-part of U.S. patent application Ser. No. 13/761,863, filed on Feb. 7, 2013, which claims priority to U.S. Provisional Patent Application No. 61/701,533, filed on Sep. 14, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a multiple-material iron-type golf club head. More specifically, the present invention relates to an iron-type golf club with composite material disposed on or over a rear surface of the golf club head.

2. Description of the Related Art

The prior art discloses various types of golf club heads having multiple materials, and various types of golf club heads with sound-enhancing features. There is a need for a golf club head having multiple material configurations that both benefit sound and enhance the mass properties of the golf club head.

BRIEF SUMMARY OF THE INVENTION

The present invention provides an iron-type golf club with features that optimize both sound and mass properties, including moment of inertia, center of gravity (CG) location, and the overall weight of the golf club head.

One aspect of the present invention is an iron-type golf club head comprising a cavity and a composite back cap. Another aspect of the present invention is an iron-type golf club head comprising a back flange and a thin layer of composite affixed to a surface of the back flange.

Yet another aspect of the present invention is an iron-type golf club head comprising a face component, a body having a top portion, a sole portion, a heel portion, a toe portion, a rear cavity, and a rear flange extending upwards from the sole portion, and a composite material affixed to at least part of an external surface of the rear flange. In some embodiments, the composite material may be a 45 degree composite. In other embodiments, the composite material may have a constant thickness of no less than 0.001 inch and no more than 0.500 inch, or it may have a variable thickness ranging from 0.001 inch to 0.500 inch.

In still other embodiments, the face component may be a face plate, and the rear flange may comprise a forward extending portion. In a further embodiment, the face plate may be welded to the top portion, sole portion, heel, and toe of the body, and may be brazed to a forwardmost surface of the forward extending portion. In another further embodiment, the iron-type golf club head may comprise a cavity enclosed by the heel, toe, flange, forward extending portion, and face plate, which may be filled with a lightweight material selected from the group consisting of composite, plastic, rubber, and aluminum alloy. In some embodiments, the face plate may compose part of the top portion and part of the sole portion.

In other embodiments, the face component may be a face insert. In some embodiments, the composite material may be affixed to the flange with an adhesive material, and may be affixed to an entire rear surface of the flange. The body of the iron-type golf club head may be composed of a metal alloy material, and the flange may extend upwards from the sole portion and makes contact with the top portion. In some embodiments, the composite material may be affixed to an upper end of the flange and extends upward to make contact with the top portion. In a further embodiment, this composite material may enclose the rear cavity.

Another aspect of the present invention is a set of iron-type golf clubs comprising a first club head comprising a body with a first rear flange, a first face place, and a first composite component, and a second club head comprising a body with a second rear flange, a second face plate, and a second composite component, wherein the first composite component is affixed with adhesive to an external surface of the first rear flange, wherein the second composite component is affixed with adhesive to an external surface of the second rear flange, wherein the thickness of the first rear flange is greater than the thickness of the second rear flange, and wherein the thickness of the first composite component is smaller than the thickness of the second composite component.

Yet another aspect of the present invention is an iron-type golf club head comprising a face plate, a body having a top portion, a sole portion, a heel portion, a toe portion, a rear cavity, and a rear flange extending upwards from the sole portion, and a composite material affixed with adhesive to the entire rear, external surface of the rear flange, wherein the composite material is composed of 45 degree carbon composite with a constant thickness of no less than 0.001 inch and no more than 0.050 inch, wherein the rear flange comprises a forward extending portion, wherein the face plate is welded to the top portion, sole portion, heel portion, and toe portion of the body, and wherein the face plate is brazed to a forwardmost surface of the forward extending portion. In some embodiments, the composite material may be affixed to the top portion of the body and enclose the rear cavity. In other embodiments, the face plate may be composed of a first material having a first density, the body may be composed of a second material having a second density, and the first density may differ from the second density.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
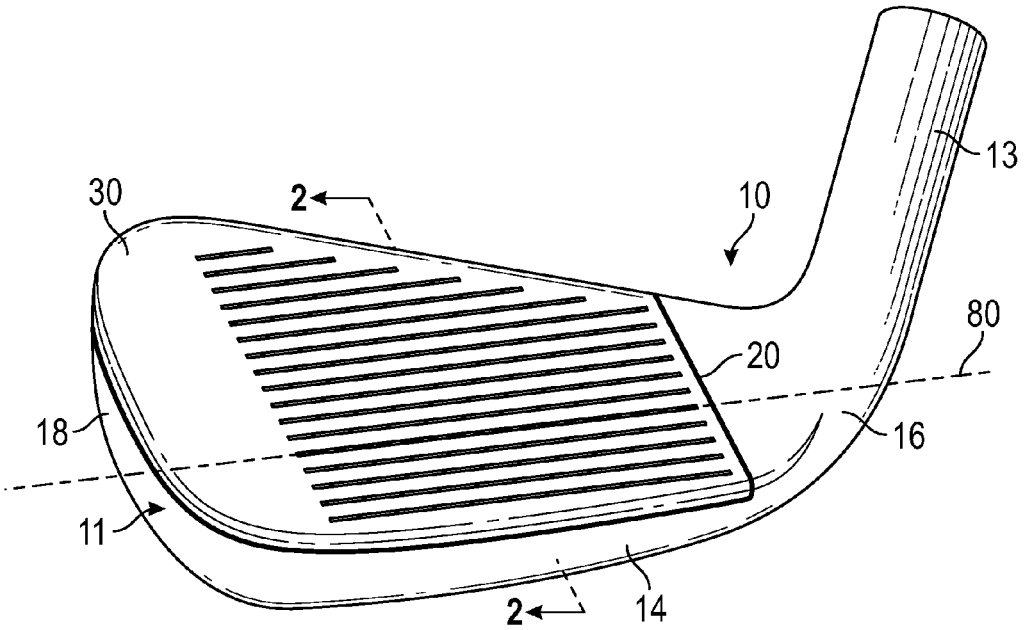
FIG. 1 is a front perspective view of a first embodiment of the present invention.
Figure 2:
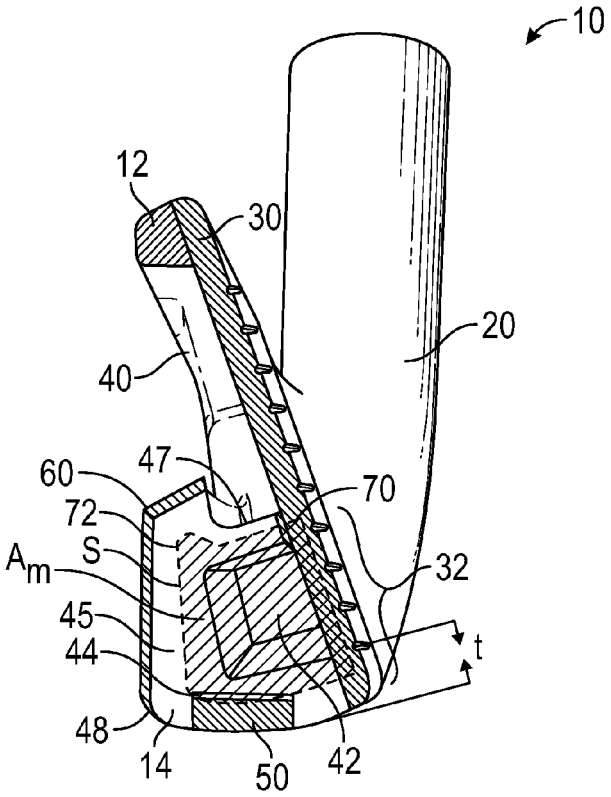
FIG. 2 is a cross-sectional view of the first embodiment along lines 2-2.
Figure 4:
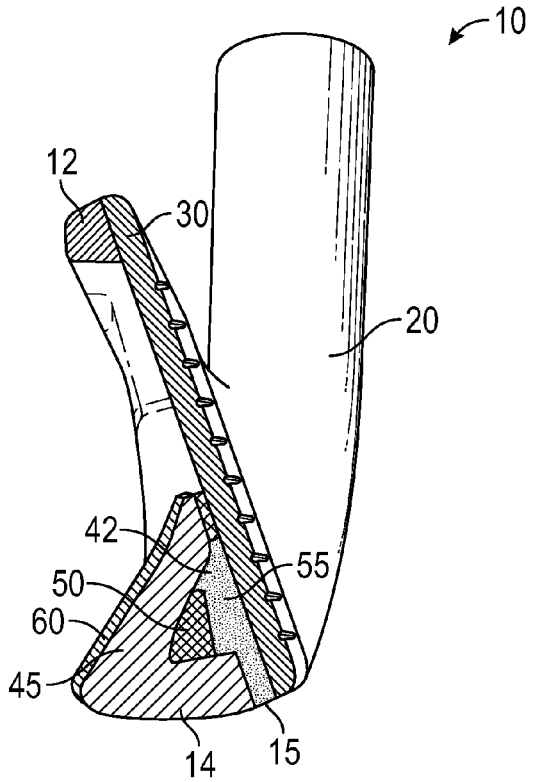
FIG. 4 is a cross-sectional view of the second embodiment along lines 4-4.

A preferred embodiment of the iron-type golf club head 10 of the present invention is shown in FIGS. 1-2. The golf club head 10 has a top portion 12 (also called a top rail), a sole portion 14, a heel portion 16, a toe portion 18, a hosel 20, a face plate 30, a rear cavity 40, and a rear flange 45 that extends from and is approximately perpendicular to the rearmost edge of the sole portion 14. The face plate 30 extends from a lowermost edge of the sole portion 14 to an uppermost edge of the top portion 12, is welded to both of these parts, and forms part of the surface of the top portion 12 and the sole portion 14 as shown in FIG. 4. In alternative embodiments, however, the face plate 30 may function as a face insert and not extend completely from the lowest edge of the sole portion 14 to the uppermost edge of the top portion 12.

The rear flange 45 includes a forward projecting portion 47 that extends from and is approximately perpendicular to the rear flange 45, and extends towards the face plate 30. The face plate 30 preferably is brazed to a forwardmost surface of the forward projecting portion 47, though in alternative embodiments the face plate 30 may be welded, glued, or otherwise affixed to the forward projecting portion 47. The golf club head 10 also includes an internal cavity 42 that is bounded by the rear flange 45, the forward projecting portion 47, the heel portion 16, the toe portion 18, and the face plate 30, and a sole cavity 44 that is filled with a high-density weight 50. The internal cavity 42 may be filled with any material known to a person skilled in the art, but preferably is left empty to reduce the overall weight of the golf club head 10.

The lower portion of the iron club head shown in FIG. 2 behaves in torsion about an axis 80 extending from the heel to toe as a closed cell beam. The closed cell 70 surrounds the internal cavity 42 and is composed of the rear flange 45, the forward projecting portion 47, a lower portion 32 of the face plate 30, and the sole portion 14. It is considered closed by the existence of the connection of the forward projecting portion 47 with the face plate 30 by brazing, welding, bonding or other means of affixing the two components. The torsional rigidity, GJ, of a closed cell section can be approximated by:

$$GJ = \frac{4A_n^2}{\oint \frac{\sum s}{Gt}}$$

where s is the closed cell contour coordinate which follows a wall midplane 72 around the cross-section, ds is a differential element of that coordinate, G is the shear modulus of elasticity of the wall material, t is the local wall thickness perpendicular to the midplane contour, and $A_m$ is the area enclosed by the midplane of the thickness around the closed cell contour.

Torsional rigidity, GJ, of the lower portion of an iron-type club head 10 can be increased by adding carbon composite sheet 60 to the cross-section as shown in FIG. 2. The composite sheet 60 preferably is affixed with an adhesive to a rear surface of the rear flange 45. This composite sheet 60, which has a thickness ranging from 0.001 to 0.500 inch, preferably extends from the point 48 at which the sole portion 14 contacts the rear flange 45 to the top most surface of the rear flange 45, and more preferably covers the entire rear surface of the rear flange 45, though in some embodiments the composite sheet 60 may extend onto or be solely affixed to the sole portion 14. The composite sheet 60, which preferably is composed of a multi-directional composite laminate, and most preferably by composite composed of plies oriented at ±45 degrees with respect the heel to toe axis 80 (which is perpendicular to the plane of the cross-section shown in FIG. 2), increases the torsional stiffness of the golf club head 10 while at the same time improving sound performance. While fiber orientations other than ±45 degrees can be used, the ±45 degree orientation allows for the greatest increase in shear modulus of elasticity, and lower angles will have less effect on torsional rigidity. In another embodiment, the composite sheet 60 is composed of a single ply of composite prepreg with a thickness of approximately 0.005 inch.

When a composite sheet 60 is included with the golf club head 10 as shown in FIG. 2, the variable G is replaced by the effective shear modulus, $G_{eff}$, of the combined carbon composite and parent material, which is given by;

$$G_{eff} = \frac{G_1 t_1 _ G_2 t_2}{t_1 + t_2}$$

where, $G_1$ is the shear modulus of elasticity of the parent material, $t_1$ is the thickness of the parent material, $G_2$ is the shear modulus of elasticity of the carbon composite material, $t_2$ is the thickness of the carbon composite material, and t=total thickness of the carbon composite plus the parent material=$t_1+t_2$.

An additional benefit of using carbon composite with the golf club head 10 of the present invention is its low density relative to materials typically used in the face, sole and flange of irons. As a result, a significant increase in torsional stiffness can be achieved at a very low mass. This approach allows the vibration and feel properties of the head to be improved without adversely affecting key mass properties such as center of gravity location. The inherent damping properties of composite materials and the adhesive bond joining it to the parent structure also improve the impact feel and sound properties of the club head.

Figure 3:
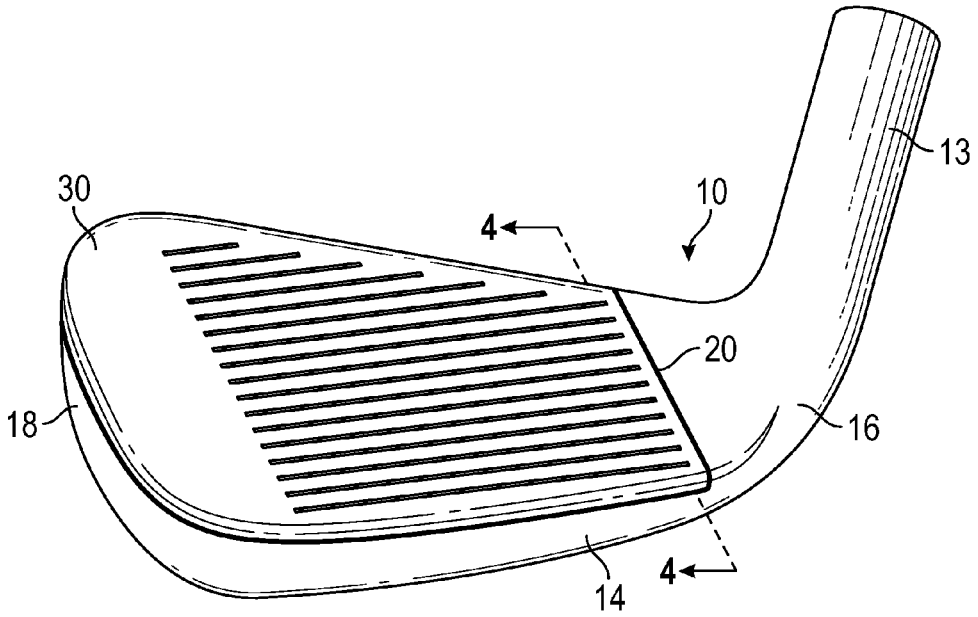
FIG. 3 is a front perspective view of a second embodiment of the present invention.

Another embodiment of the golf club head 10 is shown in FIGS. 3-4. Like the preferred embodiment, this embodiment includes a face plate 30 affixed to a body having a top portion 12, sole portion 14, heel portion 16, toe portion 18, hosel 20, rear cavity 40, and rear flange 45, though in this embodiment the rear flange 45 extends diagonally upwards from a rearward-most edge of the sole portion 14 and projects towards the face plate 30. As in the preferred embodiment, this embodiment includes a composite sheet 60 that is adhered to and covers the entire rear surface of the rear flange 45.

As shown in FIG. 4, the face plate 30 is affixed to a forwardmost surface of the rear flange 45 via brazing. Together with the sole portion 14, heel portion 16, toe portion 18, and face plate 30, the rear flange 45 creates an internal cavity 42, which in this embodiment includes a high-density weight 50, which preferably is composed of a tungsten alloy. Any additional space within the internal cavity 42 is filled with a low density polymer material 55 to improve the resilience of the face. This polymer material 55, which preferably is a rubber material, is injected through a hole 15 in the sole portion 14, which can be closed off with a simple plug (not shown).

Figure 5:
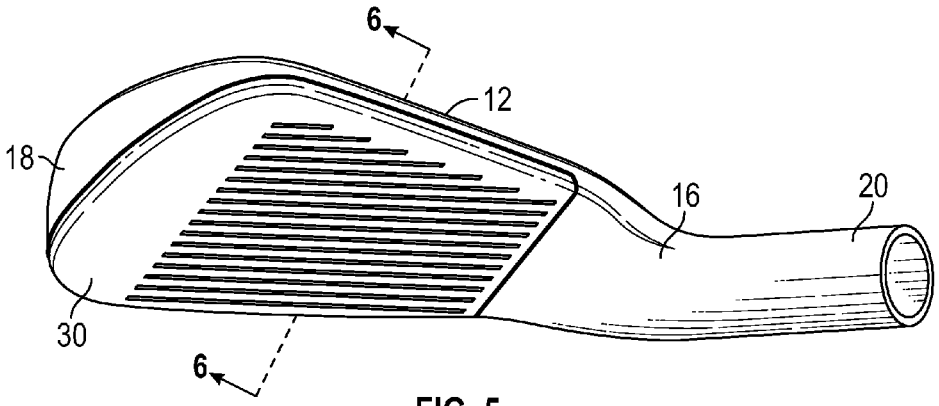
FIG. 5 is a top, perspective view of a third embodiment of the present invention.
Figure 6:
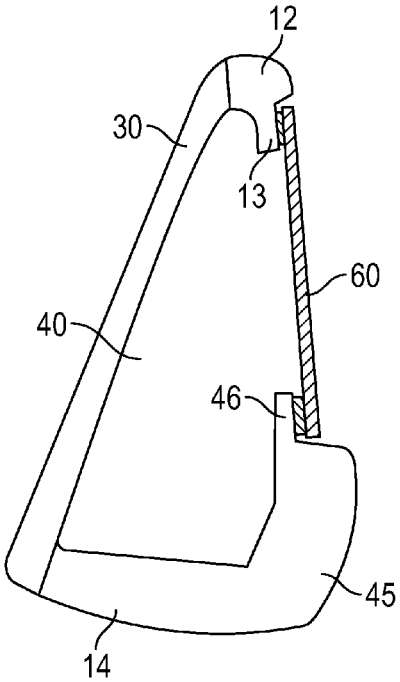
FIG. 6 is a cross-sectional view of the third embodiment along lines 6-6.
Figure 7:
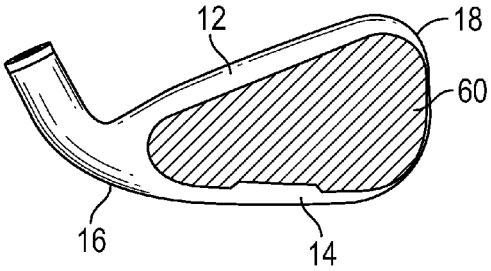
FIG. 7 is a rear perspective view of the third embodiment shown in FIG. 5.

In another embodiment, shown in FIGS. 5-7, the composite sheet 60 is affixed to a first lip 46 extending from the rear flange 45 and a second lip 13 extending from a lower surface of the top portion 12, and in this way closes the rear cavity 40 of the golf club head 10.

The disclosure of U.S. patent application Ser. No. 13/761,863 is hereby incorporated by reference in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A set of iron-type golf clubs comprising:

a first club head comprising a body with a first rear flange, a first face plate, and a first composite component; and a second club head comprising a body with a second rear flange, a second face plate, and a second composite component, wherein the first composite component is affixed with adhesive to an external surface of the first rear flange, wherein the second composite component is affixed with adhesive to an external surface of the second rear flange, wherein the thickness of the first rear flange is greater than the thickness of the second rear flange, and wherein the thickness of the first composite component is smaller than the thickness of the second composite component.

2. An iron-type golf club head comprising:

a face plate;

a body having a top portion, a sole portion, a heel portion, a toe portion, a rear cavity, and a rear flange extending upwards from the sole portion; and a composite material affixed with adhesive to the entire rear, external surface of the rear flange, wherein the composite material is composed of 45 degree carbon composite with a constant thickness of no less than 0.001 inch and no more than 0.050 inch, wherein the rear flange comprises a forward extending portion, wherein the face plate is welded to the top portion, sole portion, heel portion, and toe portion of the body, and wherein the face plate is brazed to a forwardmost surface of the forward extending portion.

3. The iron-type golf club head of claim 2, wherein the composite material is affixed to the top portion of the body and encloses the rear cavity.

4. The iron-type golf club head of claim 2, wherein the face plate is composed of a first material having a first density, wherein the body is composed of a second material having a second density, and wherein the first density differs from the second density.

* * * * *